US011333087B2

(12) United States Patent
Olsén et al.

(10) Patent No.: US 11,333,087 B2
(45) Date of Patent: May 17, 2022

(54) METHOD FOR CONTROLLING A TURBOCHARGER SYSTEM WITH A PRESSURIZED GAS TANK CONNECTED TO AN EXHAUST MANIFOLD OF A COMBUSTION ENGINE

(71) Applicant: VOLVO TRUCK CORPORATION, Gothenburg (SE)

(72) Inventors: Marcus Olsén, Kungsbacka (SE); Johan Larsson, Uddevalla (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/766,459

(22) PCT Filed: Nov. 24, 2017

(86) PCT No.: PCT/EP2017/080370
§ 371 (c)(1),
(2) Date: May 22, 2020

(87) PCT Pub. No.: WO2019/101333
PCT Pub. Date: May 31, 2019

(65) Prior Publication Data
US 2020/0378320 A1 Dec. 3, 2020

(51) Int. Cl.
*F02D 41/00* (2006.01)
*F01N 3/08* (2006.01)
*F01N 9/00* (2006.01)

(52) U.S. Cl.
CPC ..... *F02D 41/0007* (2013.01); *F01N 9/00* (2013.01); *F01N 3/0842* (2013.01);
(Continued)

(58) Field of Classification Search
CPC ..... F02D 41/0007; F02D 41/1465; F02D 2250/36; F01N 3/0842; F01N 3/08;
(Continued)

(56) References Cited

U.S. PATENT DOCUMENTS 9,322,322 B2 4/2016 Almkvist et al.
2003/0180196 A1* 9/2003 Gillespie ..... F01N 3/2066 423/239.2
(Continued)

FOREIGN PATENT DOCUMENTS

CN 103180582 A 6/2013
CN 103502601 A 1/2014
(Continued)

OTHER PUBLICATIONS

International Search Report and Written Opinion in corresponding international application No. PCT/EP2017/080370 dated Aug. 6, 2018 (12 pages).
(Continued)

*Primary Examiner* — Audrey B. Walter
*Assistant Examiner* — Dapinder Singh
(74) *Attorney, Agent, or Firm* — Venable LLP; Jeffri A. Kaminski

(57) ABSTRACT

A method for controlling a turbocharger system fluidly connected to an exhaust manifold of a combustion engine and an exhaust after treatment system. The turbocharger system comprises a turbocharger turbine operable by exhaust gases from the exhaust manifold, and a tank with pressurized gas, the tank being fluidly connectable to the turbocharger turbine. The method comprises the steps of: determining a NOx parameter being indicative of, or correlated to, NOx emissions from the exhaust after treatment system; and injecting pressurized gas from the tank to drive the turbocharger turbine based on the determined NOx
(Continued)

parameter, wherein a determined NOx parameter above a pre-defined first threshold determines that pressurized gas from the tank is injected.

15 Claims, 4 Drawing Sheets

(52) U.S. Cl.
CPC .... *F01N 2560/026* (2013.01); *F01N 2560/06* (2013.01); *F02D 2250/36* (2013.01)

(58) Field of Classification Search
CPC .. F01N 9/00; F01N 2560/026; F01N 2560/06; F02B 21/00; F02B 37/10; Y02T 10/12
See application file for complete search history.

(56) References Cited

U.S. PATENT DOCUMENTS

| | | | | |
|---|---|---|---|---|
| 2011/0288715 | A1 | 11/2011 | Schaffeld et al. | |
| 2013/0305709 | A1 | 11/2013 | Rollinger et al. | |
| 2013/0305714 | A1 | 11/2013 | Rollinger et al. | |
| 2013/0305716 | A1* | 11/2013 | Rollinger | F02B 37/14 60/605.2 |
| 2016/0047337 | A1 | 2/2016 | Leone | |
| 2017/0009676 | A1* | 1/2017 | Sano | F02M 26/25 |
| 2017/0058805 | A1* | 3/2017 | Ford | F01N 3/0885 |

FOREIGN PATENT DOCUMENTS

| | | | |
|---|---|---|---|
| CN | 103993935 | A | 8/2014 |
| CN | 105229285 | A | 1/2016 |
| EP | 1233162 | A1 | 8/2002 |
| EP | 2749751 | A1 | 7/2014 |
| EP | 2960458 | A1 | 12/2015 |
| EP | 3121432 | A1 | 1/2017 |
| JP | H11343856 | A | 12/1999 |

OTHER PUBLICATIONS

International Preliminary Report on Patentability in corresponding international application No. PCT/EP2017/080370 dated Feb. 13, 2020 (17 pages).

Dariusz Cieslar et al.; "A Novel System for Reducing Turbo-Lag by Injection of Compressed Gas into the Exhaust Manifold"; University of Cambridge; ; SAE International; Published Apr. 8, 2013; 8 pages.

China Office Action dated Dec. 21, 2021 in corresponding China Patent Application No. 201780097183.5, 22 pages.

* cited by examiner

METHOD FOR CONTROLLING A TURBOCHARGER SYSTEM WITH A PRESSURIZED GAS TANK CONNECTED TO AN EXHAUST MANIFOLD OF A COMBUSTION ENGINE

CROSS-REFERENCE TO RELATED APPLICATIONS

This application is a U.S. National Stage application of PCT/EP2017/080370, filed Nov. 24, 2017 and published on May 31, 2019 as WO 2019/101333, all of which is hereby incorporated by reference in its entity.

TECHNICAL FIELD

The invention relates to a method for controlling a turbocharger system fluidly connected to an exhaust manifold of a combustion engine and an exhaust after treatment system. The invention further relates to a computer program, a computer readable medium carrying a computer program, and to a control unit configured to perform the steps of the method for controlling a turbocharger system. The invention further relates to a turbocharger system, and to a vehicle comprising such turbocharger system or such control unit.

The invention is applicable on vehicles, in particularly low, medium and heavy duty vehicles commonly referred to as trucks. Although the invention will mainly be described in relation to a truck, it may also be applicable for other type of vehicles. Moreover, the invention is applicable to stationary combustion engines, such as e.g. combustion engines designed and configured for the production of electricity.

BACKGROUND

A turbocharger, or a turbo, is a turbine-driven forced induction device that increases the efficiency and power output of a combustion engine, by forcing extra gas into the combustion engine. The turbocharger typically comprises a turbocharger turbine and a turbocharger compressor, the latter being driven by the turbocharger turbine. The improvement for a turbo-equipped combustion engine compared to a combustion engine operating without a turbo is that the turbocharger compressor can deliver more air/gas, into the cylinders of the combustion engine. Consequently, more fuel can be burnt.

In EP 2960458 a turbocharger system comprising a tank, which is recharged by e.g. a compressor compressing a gas such as air into the tank, is used to provide pressurized gas into an exhaust manifold of the combustion engine, during a predetermined pulse duration time period in order to obtain initial turbocharger compressor spin-up. However, the use of compressed gas is costly, and internal components of the turbocharger system risk to be worn out too quickly due to frequent activations of the turbocharger system.

Thus, there is still a need in the industry for further improvements relating to activation of a turbocharger system.

SUMMARY

In view of the above-mentioned and other drawbacks of the prior art, the object of the present inventive concept is to provide an improved method of controlling a turbocharger system fluidly connected to an exhaust manifold of a combustion engine, and more specifically, for at least some engine operational modes of the vehicle, to improve the torque response of the combustion engine. The object is achieved by a method according to claim 1.

According to a first aspect of the invention, a method for controlling a turbocharger system fluidly connected to an exhaust manifold of a combustion engine and an exhaust after treatment system is provided. The turbocharger system comprises a turbocharger turbine operable by exhaust gases from said exhaust manifold, and a tank with pressurized gas, said tank being fluidly connectable to said turbocharger turbine. The method comprises the steps of:

determining a NOx parameter being indicative of, or correlated to, NOx emissions from said exhaust after treatment system;

injecting pressurized gas from said tank to drive said turbocharger turbine based on the determined NOx parameter, wherein a determined NOx parameter above a pre-defined first threshold determines that pressurized gas from said tank is injected.

By the provision of a method which comprises the step of injecting pressurized gas from said tank to drive said turbocharger turbine based on the determined NOx parameter, the pressurized gas can be used to drive, or at least contribute in driving, the turbocharger turbine in response to the NOx parameter, or NOx emissions, of the exhaust after treatment system. Thus, pressurized gas in injected in such a way that the turbocharger turbine is at least partly driven by said pressurized gas, in response to the NOx parameter, or NOx emissions, of the exhaust after treatment system. Moreover, the determined NOx parameter can be used to determine that the pressurized gas needs not to be injected from said tank, i.e. to decide not to inject pressurized gas from said tank. Hence, at least the parts of the turbocharger system related to the injection of pressurized gas from said tank can be used less frequent, and can thus be kept functional for a longer period.

It should be noted that the step of injecting pressurized gas from said tank to drive said turbocharger turbine, should be interpreted as that the pressurized gas from said tank is used to drive, or at least contribute in driving, the turbocharger turbine. Hence the turbocharger turbine may additionality to the pressurized gas from said tank, be driven by exhaust gases from said exhaust manifold.

According to one embodiment, the method comprises the step of deactivating injection functionality of pressurized gas from said tank based on the determined NOx parameter, wherein a determined NOx parameter below said pre-defined first threshold determines that injection functionality of pressurized gas from said tank is deactivated.

Hence, the use of pressurized gas can be reduced in response to the determined NOx parameter. In other words, the use of pressurized gas can be adapted to the determined NOx parameter. The injection functionality may e.g. be deactivated by locking a valve controlling the release of pressurized gas from said tank in a closed position, or simply not allowing the tank to be re-charged with pressurized gas by e.g. deactivating a compressor configured for charging the tank with pressurized gas.

For example, and according to at least one embodiment, the operational mode of the combustion engine, i.e. the engine operational mode, may be set based on the determined NOx parameter and the possibility of having pressurized gas injected from said tank. Hereby, a greater variety of choices for the engine operational mode is provided as the engine operational mode needs not only to be based on the determined NOx parameter, but as well as the capability of injecting pressurized gas from said tank.

According to one embodiment, the method comprises the step of operating said combustion engine in a low NOx mode based on the determined NOx parameter, wherein a determined NOx parameter above a pre-defined second threshold determines that the combustion engine is operated in said low NOx mode and/or comprising the step of operating said combustion engine in a high responsive fuel economy mode, based on the determined NOx parameter, wherein a determined NOx parameter below a pre-defined third threshold determines that the combustion engine is operated in said high responsive fuel economy mode.

Thus, the pressurized gas from said tank may be used to compensate for a poor engine performance, such as e.g. a poor torque response, in said low NOx mode and/or the injection of pressurized gas from said tank may be deactivated (i.e. not initiated, or hindered to be initiated), or terminated, in said high responsive fuel economy mode.

According to one embodiment, the step of injecting pressurized gas from said tank is carried out when said combustion engine is operated in said low NOx mode. According to one embodiment, the step of operating said combustion engine in a low NOx mode is decisive to the step of injecting pressurized gas from said tank to drive said turbocharger turbine. In other words, the determined NOx parameter may be decisive for operating the combustion engine in said low NOx mode, and may be decisive for injecting pressurized gas from said tank to drive said turbocharger turbine. Hereby, the injection of pressurized gas from said tank can compensate for a relatively low torque response in said low NOx mode.

According to one embodiment, said pre-defined second threshold is equal to or smaller than said pre-defined first threshold. Thus, according to one embodiment, the method comprises the step of operating said combustion engine in said low NOx mode based on the determined NOx parameter, wherein a determined NOx parameter above said pre-defined first threshold determines that the combustion engine is operated in said low NOx mode.

According to one embodiment, the step of deactivating injection functionality of pressurized gas from said tank is carried out prior to setting said combustion engine to operate in said high responsive fuel economy mode. Hence, for such embodiments, the injection functionality of the pressurized gas from said tank is already deactivated when the combustion engine is set to operate in said high responsive fuel economy mode. However, according to one alternative embodiment, the step of deactivating injection functionality of pressurized gas from said tank is based on the determined NOx parameter, wherein a determined NOx parameter below said pre-defined third threshold determines that injection functionality of pressurized gas from said tank is deactivated. Hence, the step of operating said combustion engine in a high responsive fuel economy mode may be decisive for the step of deactivating injection functionality of pressurized gas from said tank. In other words, the determined NOx parameter may be decisive for operating the combustion engine in said high responsive fuel economy mode, and may be decisive for deactivating injection functionality of pressurized gas from said tank.

Hereby, the use of pressurized gas can be reduced as injection of pressurized gas from said tank is hindered, as relatively less pressurized gas is needed in the high responsive fuel economy mode.

According to one embodiment, said pre-defined third threshold is equal to or smaller than said pre-defined first threshold and/or equal to or smaller than said pre-defined second threshold. Thus, according to one embodiment, the method comprises the step of operating said combustion engine in a high responsive fuel economy mode, based on the determined NOx parameter, wherein a determined NOx parameter below said pre-defined first threshold determines that the combustion engine is operated in said high responsive fuel economy mode.

According to one embodiment, the pre-defined first threshold is equal to the pre-defined second threshold and/or the pre-defined third threshold. According to one embodiment, the pre-defined first threshold is within 10% of the pre-defined second threshold and/or the pre-defined third threshold.

It should be understood that the combustion engine typically has a plurality of engine operational modes corresponding to modes or states or conditions to how the combustion engine is operated, and that some of the engine operational modes corresponds to a state in which combustion engine is operated in order to reduce the NOx emissions, i.e. a low NOx mode. Hence, engine parameters, such as e.g. air inlet temperature, timing of fuel injection, etc. may be adapted to fulfil the reduced NOx emissions, at the expense of other engine performance parameters, such as e.g. fuel economy and torque response. It should be noted that the low NOx mode and the high responsive fuel economy mode are examples of engine operational modes. The high responsive fuel economy mode may be referred to as a fuel economy mode defined by that 90% of the maximum torque should be reached from a level of 0-10% of the maximum torque, for a time period of below 1 second, or between 1 second and 2 seconds, or at least below 3 seconds.

The engine operation mode may be set or controlled by e.g. a control unit, whereby instructions to set or to control specific components in the combustion engine are sent as output signals from the control unit to the relevant components.

Described differently, when the combustion engine is operated in the low NOx mode, engine parameters are adapted to reduce the NOx emissions, for example to reduce peak temperature in the combustion engine, reduce residence time at said peak temperature, use of oxygen instead of air, etc. Thus, by determining said NOx parameter, and based on a state in which the determined NOx parameter is above a pre-defined second threshold, operating the combustion engine in a low NOx mode, the NOx emissions can be reduced. In said low NOx mode, the combustion engine is thus operated to reduce NOx emissions, and other combustion engine performance parameters, such as e.g. power or torque, are typically impaired at the expense of the reduced NOx emissions. Hereby, injection of pressurized gas from said tank to at least partly drive the turbocharger turbine can be used to compensate for at least one of the impaired engine performance parameters in the low NOx mode, such as e.g. torque response. In other words, based on an engine operational mode in which the combustion engine is operated to reduce the NOx emissions, i.e. the low NOx mode, injection of pressurized gas from said tank to at least partly drive said turbocharger turbine may be initiated in order to compensate for an impaired engine performance parameter, such as e.g. torque response, and thus to increase the drivability of the combustion engine. Thus, according to one embodiment the method may be referred to as a method for improving drivability of a combustion engine, e.g. by improving torque response, during an operation of the combustion engine in a low NOx mode.

Described differently, and according to one embodiment, the injection of pressurized gas from said tank is adapted based on said engine operational mode, in order to drive the turbocharger turbine to compensate for an impaired engine performance parameter of said engine operational mode.

It should be noted that the term "determining" a specific parameter (as e.g. the NOx parameter) may comprise the means of detecting, measuring or modelling the specific parameter. For example, the step of determining the NOx parameter may comprise modelling or measuring the NOx emissions. Thus, a modelled or measured NOx emission above said pre-defined first threshold, such as e.g. a pre-defined first NOx threshold, determines that pressurized gas from said tank is injected. Correspondingly, a modelled or measure NOx emission below said pre-defined first threshold (or pre-defined first NOx threshold), determines not to inject pressurized gas from said tank, or determines to deactivate the injection functionality of pressurized gas from said tank.

According to one embodiment, the NOx parameter has a direct relationship with the NOx emissions. According to one alternative embodiment, the NOx parameter has an inverse relationship with the NOx emissions, e.g. the inverse temperature in, or out from, the exhaust after treatment system.

According to one embodiment, the NOx parameter is the NOx concentration in, or out from, the exhaust after treatment system or is correlated to the temperature in, or out from, the exhaust after treatment system, such as e.g. the NOx concentration or inverse temperature out from a catalyst component in the exhaust after treatment system, or the NOx concentration or inverse temperature in the tailpipe downstream of the exhaust after treatment system. According to one embodiment, the NOx parameter is indicative, or correlated to, the NOx emissions out from the exhaust after treatment system, such as e.g. out from a catalyst component in the exhaust after treatment system, or in the tailpipe downstream of the exhaust after treatment system.

Thus, the actual NOx concentration in the exhaust after treatment system can be used to determine that pressurized gas from said tank is to be injected or not (or be terminated of injection function deactivated). Hereby, the steps of the method may be carried out based on the actual NOx emissions. Alternatively, the temperature in the exhaust after treatment system, which by an inverse correlation is related to the NOx concentration, can be used to determine that pressurized gas from said tank is to be injected or not (or be terminated or injection function deactivated). Hereby, a NOx parameter which is easily measured can be used. Thus, as mentioned previously, the NOx parameter may be used to model the NOx concentration in the exhaust after treatment system based on e.g. the temperature in the exhaust after treatment system, i.e. the inverse temperature in the exhaust after treatment system.

According to one embodiment, the method further comprises the step of modelling the NOx emissions, or determining the theoretical NOx emissions, based on said NOx parameter.

Hereby, a measurement of a directly indicative NOx parameter needs not to be used when determining the NOx emissions, as the NOx emissions can be modelled based on a e.g. indirectly indicative NOx parameter. Thus said step of injecting pressurized gas from said tank to drive said turbocharger turbine may be based on the modelled NOx emission or determined theoretical NOx emissions, wherein a modelled NOx emission or determined theoretical NOx emission above said pre-defined first threshold determines that pressurized gas from said tank is injected.

According to one embodiment, the NOx parameter is one of the following parameters: the air inlet temperature to the combustion engine, the air mass flow to the combustion engine, the combustion engine speed, the amount of fuel injected to the combustion engine, the timing of fuel injection to the combustion engine, the pressure of the fuel injection to the combustion engine, the EGR mass flow, and the boost pressure of the turbocharger turbine. Moreover, the NOx emissions may be modelled based on at least one of the mentioned parameters in the list above and/or the temperature in the exhaust after treatment system.

According to one embodiment, in which the NOx parameter is the NOx concentration in the exhaust after treatment system, the method comprises the step of measuring NOx emissions using a NOx measuring device arranged in said exhaust after treatment system or in which the NOx parameter is correlated to the temperature in the exhaust after treatment system, the method comprises the step of measuring the temperature using a temperature measuring device arranged in said exhaust after treatment system.

Hereby, a direct measurement of the NOx concentration, or a direct temperature measurement of the temperature, in the exhaust after treatment system may be used to determine that pressurized gas from said tank is to be injected or not (or be terminated or injection function deactivated). In embodiments in which the NOx parameter is correlated to the temperature of the exhaust after treatment system, the inverse temperature may be used as NOx parameter.

According to one embodiment, in which the NOx parameter is the NOx concentration in the exhaust after treatment system, said pre-defined first threshold is a point in the range of 0.15 g NOx/kWh to 1.5 g NOx/kWh, such as e.g. 0.69 g NOx/kWh, or 0.46 g NOx/kWh or wherein, in which the NOx parameter is correlated to the temperature in the exhaust after treatment system, said pre-defined first threshold is 1/200° C.

Hereby, a well-defined threshold can be set for the injection of pressurized gas from said tank. In other words, pressurized gas may be injected from said tank if the NOx parameter is above 0.15 g NOx/kWh, such as e.g. above 0.46 g NOx/kWh, such as e.g. above 0.69 g NOx/kWh, or above 1.5 g NOx/kWh. Or pressurized gas may be injected from said tank if the NOx parameter is above 1/200° C., such as e.g. above a value of between 0 and 1/200° C. In other words, pressurized gas may be injected from said tank if the temperature of the exhaust gases in, or out from, the exhaust after treatment system is below 200° C.

It should be noted that said pre-defined second or third threshold, in which the NOx parameter is the NOx concentration in the exhaust after treatment system, may be a point in the range of 0.15 g NOx/kWh to 1.5 g NOx/kWh, such as e.g. 0.69 g NOx/kWh, or 0.46 g NOx/kWh or wherein, in which the NOx parameter is correlated to the temperature in the exhaust after treatment system, may be 1/200° C.

Thus, the pre-defined first, second and third threshold may be NOx parameter specific, and thus may be referred to as a pre-defined first NOx parameter threshold, a pre-defined second NOx parameter threshold and a pre-defined third NOx parameter threshold, respectively. In other words, the predefined first, second and third thresholds may be adapted based on the specific NOx parameter.

According to one embodiment, said step of injecting pressurized gas from said tank to drive said turbocharger turbine is independent of an engine speed increasing action of the combustion engine.

Thus, the use of pressurized gas can be based on the determined NOx parameter and thus, the NOx emissions, and instead of depending on the engine speed increasing action of the combustion engine, the injection of pressurized gas is dependent on the engine operational mode, such as e.g. the low NOx mode or the high responsive fuel economy mode. Hereby, the turbocharger turbine may be driven by pressurized gas from said tank independently of an engine speed increasing action of the combustion engine.

For a vehicle application, the engine speed increasing action of the combustion engine typically corresponds to a movement of the vehicle's accelerator pedal.

However, according to an alternative embodiment, when the combustion engine is operated in said low NOx mode, the injection of pressurized gas is related to the engine speed increasing action of the combustion engine, and/or to a clutching engagement of the combustion engine.

According to one embodiment, said turbocharger system comprises a valve for controlling the release of pressurized gas from said tank, and the method further comprises the step of operating the valve to release pressurized gas needed for preventing stalling of the combustion engine.

Hereby, a simple but yet effective way to control the release of pressurized gas from said tank is provided. The tank may e.g. be operated by an actuator, such as e.g. an electronic actuator, which is operated by a control unit. Moreover, the valve may control the release of pressurized gas from the tank to various locations before, to, and after the combustion engine, typically via a valve pipe fluidly connected to the valve and the respective various locations.

It should be understood that when stating that the tank is fluidly connectable to said turbocharger turbine, fluid in the tank may, in at least some operational modes, flow from the tank to the turbocharger turbine. For example, in operational modes in which the valve is opened (i.e. the valve allows fluid to pass), the tank may be in fluid connection with the turbocharger system, e.g. via a valve pipe connected to the exhaust manifold or the exhaust manifold pipe. Correspondingly, in operational modes in which the valve is closed (i.e. the valve prevents fluid to pass), no fluid is allowed to fluid from the tank to the turbocharger turbine. In other words, a fluid distribution system is typically arranged between the tank and the turbocharger system. The distribution system may comprise at least one pipe or conduit, and/or at least one valve, and/or at least some part or portion of the combustion engine.

For example, and according to one example embodiment, said turbocharger system further comprises a turbocharger compressor driven by said turbocharger turbine, and said combustion engine comprises an inlet manifold fluidly connected to said turbocharger compressor, wherein said valve controls the release of pressurized gas from said tank to the exhaust manifold of the combustion engine, to an exhaust manifold pipe arranged between the exhaust manifold and the turbocharger turbine, to the turbocharger turbine casing, to the inlet manifold of the combustion engine, to the turbocharger compressor casing, or to an inlet manifold pipe arranged between the inlet manifold and the turbocharger compressor. Hence, the valve pipe may be arranged between the valve and the exhaust manifold, the exhaust manifold pipe, the turbocharger turbine casing, the inlet manifold, the turbocharger compressor casing, or to the inlet manifold pipe.

In other words, the valve may be fluidly connectable to (e.g. via the valve pipe) the exhaust manifold, the exhaust manifold pipe, the turbocharger turbine casing, the inlet manifold, the turbocharger compressor casing, or to the inlet manifold pipe.

In embodiments where the pressurized gas from said tank is injected upstream of the exhaust manifold of said combustion engine, i.e. to the inlet manifold of said combustion engine, to the inlet manifold pipe or to the turbocharger compressor casing, the injected pressurized gas will increase the fluid pressure and allow for an increased fuel injection and/or an increase amount of burnt fuel in the combustion engine, which will result in an increased energy in the combustion engine, and hence an increased pressure in the exhaust manifold and further to the turbocharger turbine. In other words, the injection of pressurized gas upstream of the exhaust manifold, results in an increased work of the turbocharger turbine. Thus, the pressurized gas is injected from said tank to drive said turbocharger turbine.

According to one embodiment, the valve is operated in such a way that the pressurized gas is released from said tank during at least 1 second, such as e.g. between 1 second and 5 seconds.

Such operational time of the valve is suitable for at least partly driving said turbocharger turbine with pressurized gas from said tank.

According to one embodiment, the method comprises the step of initiating or increasing fuel injection to the combustion engine before, simultaneously with, or after said step of injecting pressurized gas from said tank to drive said turbocharger turbine. It should be understood that initiating or increasing fuel injection to the combustion engine should be interpreted as the act of injecting fuel. Thus, the combination of injection of pressurized gas and the injection, or increase in injection, of fuel may increase the combustion engine's efficiency and/or power output.

According to one embodiment, the method comprises the step of:

initiating or increasing fuel injection to the combustion engine after said step of determining a NOx parameter being indicative of, or correlated to, NOx emissions out from said exhaust after treatment system, and prior to said step of injecting pressurized gas from said tank to drive said turbocharger turbine. Such timing of the injection or increasing of fuel is suitable for at least partly driving said turbocharger turbine.

According to at least a second aspect of the present invention, the object is achieved by a control unit according to claim 9. The control unit is configured to perform the steps of the method described in accordance with the first aspect of the invention.

Effects and features of this second aspect of the present invention are largely analogous to those described above in connection with the first aspect of the inventive concept, respectively. Embodiments mentioned in relation to the first aspect of the present invention are largely compatible with the second aspect of the invention.

According to at least a third aspect of the invention, the object is achieved by a turbocharger system according to claim 10. More specifically, the invention relates to a turbocharger system for use together with a combustion engine having an exhaust manifold and an exhaust after treatment system fluidly connected to said exhaust manifold, said turbocharger system comprising:

a turbocharger turbine operable by exhaust gases from said exhaust manifold, a tank comprising pressurized gas, said tank being fluidly connectable to said turbocharger turbine, and a control unit wherein the control unit is configured to determine a NOx parameter being indicative of, or correlated to, NOx emissions out from said exhaust after treatment system;

initiate injection of pressurized gas from said tank to drive said turbocharger turbine based on the determined NOx parameter, wherein a determined NOx parameter above a pre-defined first threshold determines that pressurized gas from said tank is injected.

Effects and features of this third aspect of the present invention are largely analogous to those described above in connection with the first aspect of the inventive concept. Embodiments mentioned in relation to the first aspect of the present invention are largely compatible with the third aspect of the invention, of which some embodiments are explicitly mentioned in the following. In other words, a method for controlling a turbocharger system as described with any of the embodiments of the first aspect of the invention is applicable to, or may make use of, the turbocharger system described in relation to the third aspect of the invention.

The turbocharger system may further comprise a turbocharger compressor driven by the turbocharger turbine to compress intake air to said combustion engine. Hence the turbocharger system comprises a turbocharger comprising the turbocharger turbine and the turbocharger compressor mechanically coupled to the turbocharger turbine by a turbine shaft. The turbocharger turbine is driven by exhaust gases from said combustion engine, and/or by pressurized air from said tank, and the turbocharger compressor is driven by the turbocharger turbine via said turbine shaft.

The combustion engine typically comprises an inlet manifold fluidly connected to said turbocharger compressor, for supplying fuel and/or air and/or a fuel-air mixture to the combustion engine. The inlet manifold is typically fluidly connected to the turbocharger compressor via an inlet manifold pipe arranged between the inlet manifold and the turbocharger compressor. Correspondingly, the exhaust manifold is typically fluidly connected to the turbocharger turbine via an exhaust manifold pipe arranged between the exhaust manifold and the turbocharger turbine. Moreover, the exhaust after treatment system is fluidly connected to the combustion engine and the exhaust manifold, and is typically arranged downstream of said turbocharger turbine.

For example, and according to one embodiment, said control unit is configured to deactivate injection functionality of pressurized gas from said tank based on the determined NOx parameter, wherein a determined NOx parameter below said pre-defined first threshold determines that the injection functionality of pressurized gas from said tank is deactivated.

For example, and according to one embodiment, said control unit is configured to: operate said combustion engine in a low NOx mode based on the determined NOx parameter, wherein a determined NOx parameter above a pre-defined second threshold determines that the combustion engine is operated in said low NOx mode, and/or operate said combustion engine in a high responsive fuel economy mode, based on the determined NOx parameter, wherein a determined NOx parameter below a pre-defined third threshold determines that the combustion engine is operated in said high responsive fuel economy mode. Effects and features of this embodiment is analogous to the corresponding embodiment of the first aspect of the present invention and are not repeated again here.

According to one embodiment the NOx parameter is the NOx concentration in the exhaust after treatment system or is correlated to the temperature in the exhaust after treatment system. Effects and features of this embodiment is analogous to the corresponding embodiment of the first aspect of the present invention and are not repeated again here.

According to one embodiment, in which the NOx parameter is the NOx concentration in the exhaust after treatment system, said pre-defined first threshold is a point in the range of 0.15 g NOx/kWh to 1.5 g NOx/kWh, such as e.g. 0.69 g NOx/kWh, or 0.46 g NOx/kWh or wherein, in which the NOx parameter is correlated to the temperature in the exhaust after treatment system, said pre-defined first threshold is $1/200°$ C. Effects and features of this embodiment is analogous to the corresponding embodiment of the first aspect of the present invention and are not repeated again here.

According to one embodiment, the turbocharger system further comprises a valve for controlling the release of pressurized gas from said tank to the turbocharger turbine, wherein said control unit is configured to control the operation of the valve to release pressurized gas needed for at least partly drive said turbocharger turbine. Effects and features of this embodiment is analogous to the corresponding embodiment of the first aspect of the present invention and are not repeated again here.

According to at least a fourth aspect of the invention, the object is achieved by a vehicle. More specifically, the invention relates to a vehicle comprising a turbocharger system in accordance with the third aspect of the invention, or a control unit in accordance with the second aspect of the invention.

Thus, the vehicle may comprise the combustion engine and the turbocharger system and the exhaust after treatment system. Thus, the vehicle may comprise the control unit being configured according to any embodiment described with the second aspect of the invention.

According to one embodiment, the combustion engine is an internal combustion engine such as e.g. a diesel driven internal combustion engine.

According to at least a fifth aspect of the present invention, the object is achieved by a computer program, the computer program comprising program code means for performing the steps of the first aspect of the invention, when said program is run on a computer. The computer may e.g. be comprised in, or be comprised of, the control unit of the second aspect of the invention.

Effects and features of this fifth aspect of the present invention are largely analogous to those described above in connection with the first aspect of the invention. Embodiments mentioned in relation to the first aspect of the present invention are largely compatible with the fifth aspect of the invention.

According to at least a sixth aspect of the present invention, the object is achieved by a computer readable medium, the computer readable medium carrying a computer program comprising program code means for performing the steps of the first aspect of the invention, when said program product is run on a computer. The computer readable medium may e.g. be comprised in the control unit of the second aspect of the invention.

Effects and features of this sixth aspect of the present invention are largely analogous to those described above in connection with the first aspect of the invention. Embodiments mentioned in relation to the first aspect of the present invention are largely compatible with the sixth aspect of the invention.

According to a further aspect of the invention, the object is achieved by a combustion engine system comprising a combustion engine having an exhaust manifold and a turbocharger system in accordance with the third aspect of the invention of the invention. The combustion engine system may further comprise an exhaust after treatment system fluidly connected to the combustion engine and the exhaust manifold of the combustion engine.

Further advantages and advantageous features of the invention are disclosed in the following description and in the dependent claims.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
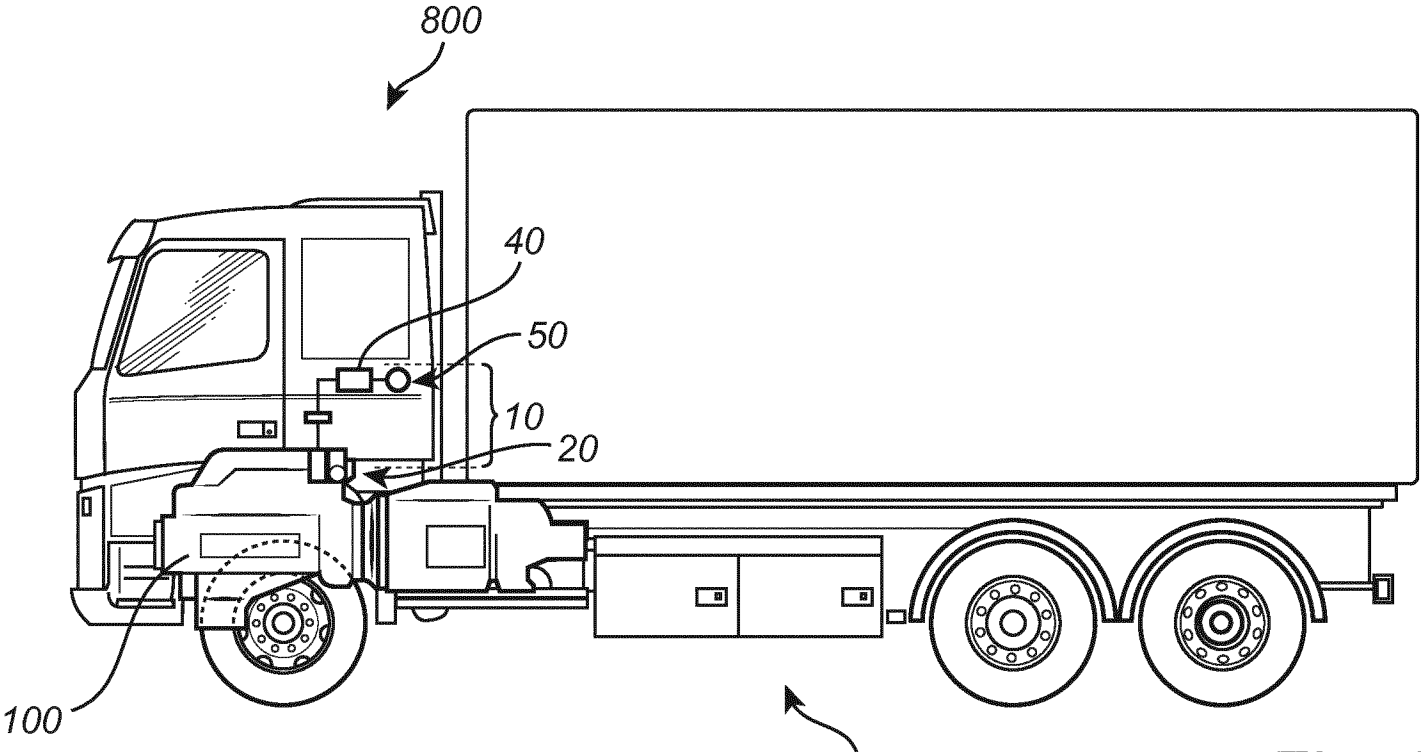
FIG. 1 is a side view of a vehicle comprising a combustion engine, a turbocharger system and an exhaust after treatment system in accordance with one example embodiment of the present invention.

The present invention will now be described more fully hereinafter with reference to the accompanying drawings, in which an exemplary embodiment of the invention is shown. The invention may, however, be embodied in many different forms and should not be construed as limited to the embodiment set forth herein; rather, the embodiment is provided for thoroughness and completeness. Like reference character refer to like elements throughout the description.

With particular reference to FIG. 1, there is provided a vehicle 800 with a combustion engine 100, such as an internal combustion engine 100, and a turbocharger system 10 comprising a turbocharger 20, a tank with pressurized air 40 and a control unit 50, such as e.g. an ECU 50, according to the present invention (further described below with reference to FIG. 2). The combustion engine 100 is fluidly connected to the turbocharger system 20 and an exhaust after treatment system 900. The vehicle 800 depicted in FIG. 1 is a truck 800 for which the inventive concept which will be described in detail below, is particularly suitable for.

Figure 2:
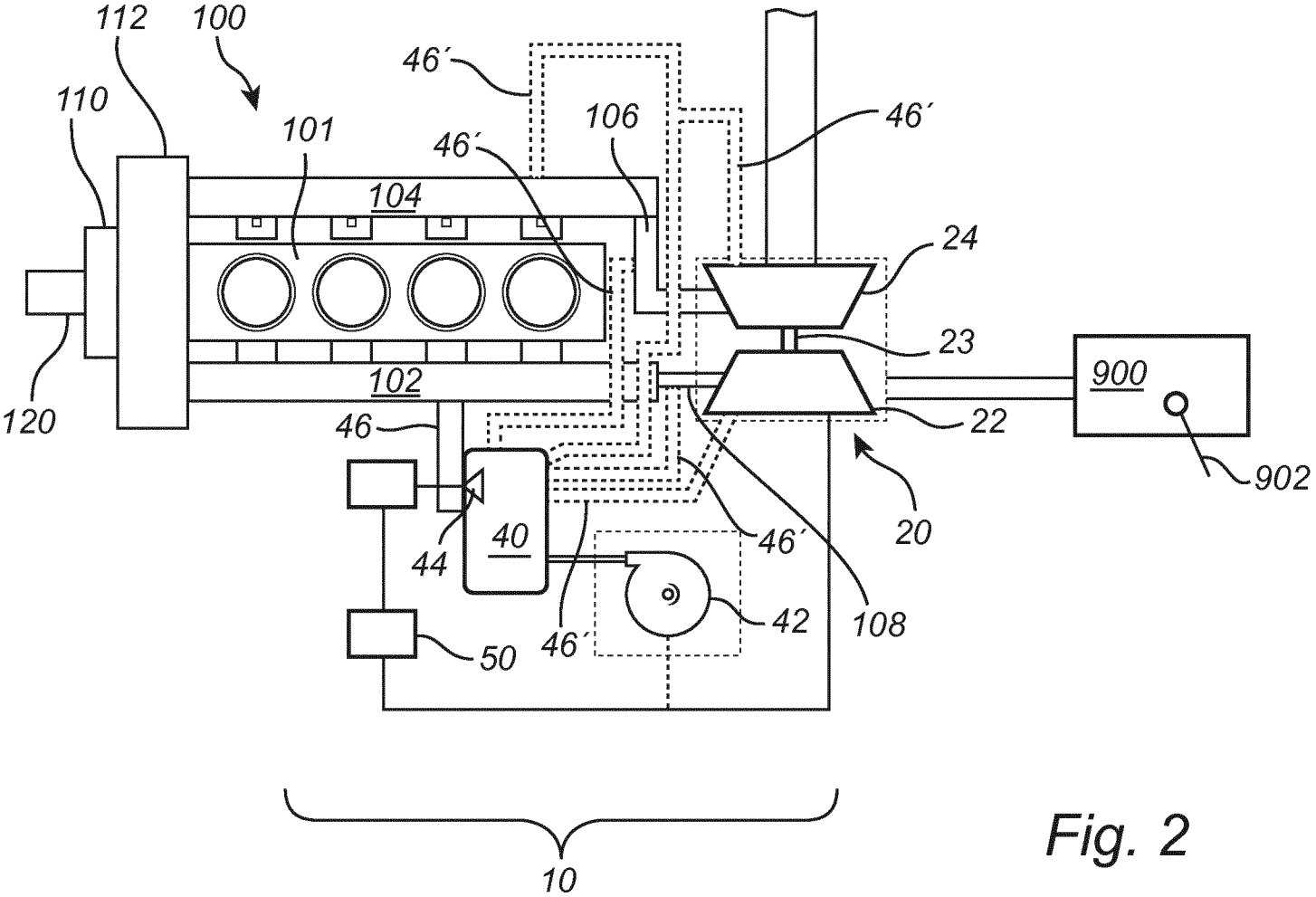
FIG. 2 shows a schematic overview of the combustion engine and the turbocharger system of FIG. 1, in accordance with one example embodiment of the present invention.

FIG. 2 shows a schematic overview of at least parts of a combustion engine 100 and a turbocharger system 10. In the non-limiting example of FIG. 2, the combustion engine 100 comprises an engine block 101 in a four-cylinder, four-stroke, diesel engine with a gear box 110 and a clutch 112 that is connected to an engine crankshaft 120. The combustion engine 100 of FIG. 2 comprises an inlet manifold 104 fluidly connected to an intake port (not shown) of the combustion engine 100, for supplying fuel and/or air and/or a fuel-air mixture to the combustion engine 100. Correspondingly, the combustion engine 100 comprises an exhaust manifold 102 fluidly connected to an exhaust after treatment system 900 of the combustion engine 100.

In the example of FIG. 2, the combustion engine 100 is overloaded by means of the turbocharger system 10. More specifically, the turbocharger system 10 comprises a turbocharger 20 having a turbocharger turbine 22 and a turbocharger compressor 24 of known type coupled to the turbocharger turbine 22 by a turbine shaft 23. The turbocharger turbine 22 is operable by exhaust gases from the exhaust manifold 102, and thus drives the turbocharger compressor 24 via the turbine shaft 23. The turbocharger compressor 24 is fluidly connected to the inlet manifold 104 via an inlet manifold pipe 106, and is configured for compressing intake air to the combustion engine 100. Optionally, an intercooler (not shown) may be arranged in fluid contact between the turbocharger compressor 24 and the inlet manifold 104. Correspondingly, the turbocharger turbine 22 is fluidly connected to the exhaust manifold 102 via an exhaust manifold pipe 108, and is configured for driving the turbocharger compressor 24 via the turbine shaft 23. In other words, the exhaust manifold pipe 108 is fluidly connected between the exhaust manifold 102 of the combustion engine 100 and the turbocharger turbine 22. The turbocharger turbine 22 is fluidly connected in between the exhaust manifold 102 of the combustion engine 100 and the exhaust after treatment system 900.

As shown in FIG. 2, the turbocharger system 10 further comprises a tank 40 with pressurized gas, a compressor 42 for supplying pressurized gas to the tank 40, and a valve 44 for controlling the release of pressurized gas from the tank 40. The turbocharger system 10 in FIG. 2 further comprises a control unit 50 connected to the valve 44 and the compressor 42. In FIG. 2, the valve 44 may control the release of pressurized gas from the tank 40 to various locations before, to, and after the combustion engine 100, typically via a valve pipe 46 fluidly connected to the valve 44 and the respective various locations. In FIG. 2, the valve pipe 46 is arranged to provide the pressurized gas from the tank 40 to the exhaust manifold 102, but as indicated with dashed valve pipes 46', the pressurized gas from the tank 40 may alternatively be injected to the exhaust manifold pipe 108, the turbocharger turbine 22 casing, the inlet manifold 104, the turbocharger compressor 24 casing, or the inlet manifold pipe 106.

The operation of the turbocharger system 10, and the function of the control unit 50 will now be described in more detail. The control unit 50 is configured to determine a NOx parameter being indicative of, or correlated to, NOx emissions out from the exhaust after treatment system 900, and initiate injection of pressurized gas from the tank 40 to drive the turbocharger turbine 22 based on the determined NOx parameter, wherein a determined NOx parameter above a pre-defined first threshold determines that pressurized gas from the tank 40 is injected. Hence, the turbocharger turbine 22 may be at least partly driven by the pressurized gas from the tank 40, and at least partly be driven by exhaust gases from the exhaust manifold 102.

Hereby, the injection of pressurized gas from the tank 40 may be determined in response to the determined NOx parameter, and thus the NOx emissions of the exhaust after treatment system 900. Hence, the combustion engine 100 may be operated in an engine operational mode in order to respond to the determined NOx parameter and the NOx emissions, and the injection of pressurized gas from the tank 40 may be adapted to such engine operational mode. Hereby, the pressurized gas from the tank 40 may be used to compensate a relative poor engine performance parameter resulting from the chosen engine operational mode and/or the pressurized gas in the tank 40 may be saved as the chosen engine operational mode is in no need for an increased spin-up of the turbocharger turbine 22 by the pressurized gas from the tank 40.

Hence, the control unit 50 may be configured to deactivate injection functionality of pressurized gas from the tank 40 based on the determined NOx parameter, wherein a determined NOx parameter below the pre-defined first threshold determines that injection functionality of pressurized gas from the tank is deactivated. Thus, the use of pressurized gas can be reduced in response to the determined NOx parameter or NOx emissions.

According to one embodiment, the control unit 50 is configured to operate the combustion engine 100 in a low NOx mode based on the determined NOx parameter, wherein a determined NOx parameter above a pre-defined second threshold determines that the combustion engine 100 is operated in the low NOx mode and/or the control unit 50 may be configured to operate the combustion engine 100 in a high responsive fuel economy mode, based on the determined NOx parameter, wherein a determined NOx parameter below a pre-defined third threshold determines that the combustion engine 100 is operated in the high responsive fuel economy mode.

As mentioned previously, the pressurized gas from the tank 40 may be used to compensate for a poor engine performance, such as e.g. a poor torque response, in the low NOx mode. Alternatively, the injection of pressurized gas from the tank 40 may be terminated, or simply not initiated, or the injection functionally may be deactivated, in the high responsive fuel economy mode, in order to reduce the use of pressurized gas.

The control unit 50 may e.g. be configured to release pressurized gas from the tank 40 for a pre-set time period of at least 1 second, or between 1 second and 5 seconds. For example, the size of the tank, and the release of pressurized gas via the valve 44, may be sized and dimensioned such that the tank 40 is fully depleted or emptied after e.g. 5 seconds. Thus, the turbocharger system 10, and the turbocharger turbine 22, may be operated by pressurized gas from the tank 40 e.g. for at least 5 seconds. When the tank has been at least partly depleted or emptied, it may be recharged using e.g. the compressor 42. According to one embodiment, the control unit 50 is configured to initiate recharging of the tank 40 with pressurized gas using the compressor 42.

As shown in FIG. 2, the exhaust after treatment system 900 comprises a measuring device 902 configured to measure a parameter, such as the NOx parameter, in the exhaust after treatment system 900. The NOx parameter may e.g. be the NOx concentration in the exhaust after treatment system 900 or the inverse temperature in the exhaust after treatment system 900. Hence, the measuring device may be a NOx measuring device 902 or a temperature measuring device 902. In case of the latter, the temperature in the exhaust after treatment system 900 may be used to model the NOx emissions, e.g. by taking the inverse measured temperature.

Figure 4:
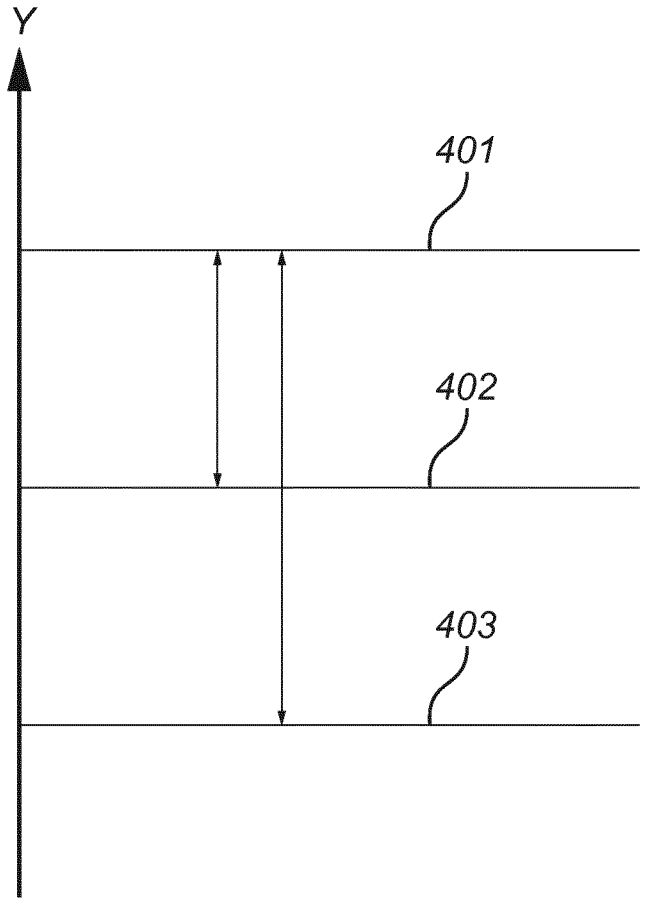
FIG. 4 is a schematic view showing the pre-defined first threshold, the pre-defined second threshold, and the pre-defined third threshold, and how they are set in relation to each other in accordance with some example embodiments of the invention.

Turning to FIG. 4 showing a schematic drawing of the pre-defined first, second and third thresholds 401-403 along an axis Y which corresponds to the NOx parameter. As seen in FIG. 4, the pre-defined second threshold 402 may be located in between the pre-defined first threshold 401 and the pre-defined third threshold 403. As also shown in FIG. 4 by the range indicating arrows, the pre-defined second threshold 402 may be equal to, or smaller than, the pre-defined first threshold 401. Correspondingly, the pre-defined third threshold 403 may be equal to, or smaller than, the pre-defined second threshold 402 and/or the pre-defined first threshold 401, also indicated by range indicating arrows. According to one embodiment, the pre-defined first threshold 401 is within 10% of the pre-defined second threshold 402 and/or the pre-defined third threshold 403. For example, the NOx parameter may be the measured NOx emissions (or the NOx parameter can be used to model the NOx emissions) and the pre-defined first threshold 401 may be 0.15 g NOx/kWh or 1.5 g NOx/kWh, or a point between 0.15 g NOx/kWh and 1.5 g NOx/kWh, such as e.g. at 0.69 g NOx/kWh, or at 0.46 g NOx/kWh. Alternatively, the NOx parameter may be correlated to the temperature (e.g. the inverse temperature) in the exhaust after treatment system 900, and the pre-defined first threshold 401 may be between 0 and $1/200°$ C. such as e.g. $1/200°$ C. The control unit 50 may comprise or hold information related to the pre-defined first threshold 401, the pre-defined second threshold 402 and/or the pre-defined third threshold 403.

Moreover, the injection of pressurized gas from the tank 40 may be independent of an engine speed increasing action of the combustion engine 100. For example, if the combustion engine 100 and the turbocharger system 10 are comprised in a vehicle 800, the injection of pressurized gas from the tank 40 may be independent of the vehicle's accelerator pedal.

It should be noted that the vehicle 800 in FIG. 1, may comprise the combustion engine 100, the turbocharger system 10 and the exhaust after treatment system 900. Thus, the vehicle 800 may comprise the control unit 50 being configured according to any embodiment described with reference to FIG. 2.

The present invention also relates to a method for controlling a turbocharger system, as e.g. the turbocharger system 10 shown in FIG. 2, fluidly connected to an exhaust manifold of a combustion engine and an exhaust after treatment system (also shown in FIG. 2). Thus, the present invention will hereafter be described with reference to the above described combustion engine 100, turbocharger system 10 and exhaust after treatment system 900 in a non-limiting way, with reference to the flow-chart in FIG. 3 (hence, the reference numerals of FIG. 1 and FIG. 2 are used below when describing the steps of the method in the flow-chart in FIG. 3).

In a first step 601, a NOx parameter being indicative of, or correlated to, NOx emissions out from the exhaust after treatment system is determined. The NOx parameter may e.g. be the NOx concentration in the exhaust after treatment system 900 or be correlated to the temperature in the exhaust after treatment system 900, measure by the measuring device 902. Thus, in an optional second step 602 the NOx emissions are measured using a NOx measuring device arranged in the exhaust after treatment system 900 or the temperature of the exhaust gases is measured using a temperature measuring device arranged in the exhaust after treatment system 900. It should be noted that the method may comprises an optional second sub-step 602' of modelling the NOx emissions, or determining the theoretical NOx emissions, based on a NOx parameter, such as e.g. the inverse temperature in the exhaust after treatment system 900.

In an optional third step 603, e.g. carried out subsequently to said first step 601, said optional second step 602 or said optional second sub-step 602', the combustion engine 100 is operated in a low NOx mode based on the determined NOx parameter from the first step 601. A determined NOx parameter above a pre-defined second threshold 402 determines that the combustion engine 100 is operated in the low NOx mode.

In an optional fourth step 604, injection functionality of pressurized gas from the tank 40 is deactivated based on the determined NOx parameter, wherein a determined NOx parameter below the pre-defined first threshold 401 determines that injection functionality of pressurized gas from the tank 40 is deactivated. Thus, pressurized gas from the tank need not to be injected to at least partly drive the turbocharger turbine 22, when the determined NOx parameter is below the pre-defined first threshold 401, as the engine operational mode can be chosen such that the pressurized gas from the tank 40 is not needed.

Figure 3:
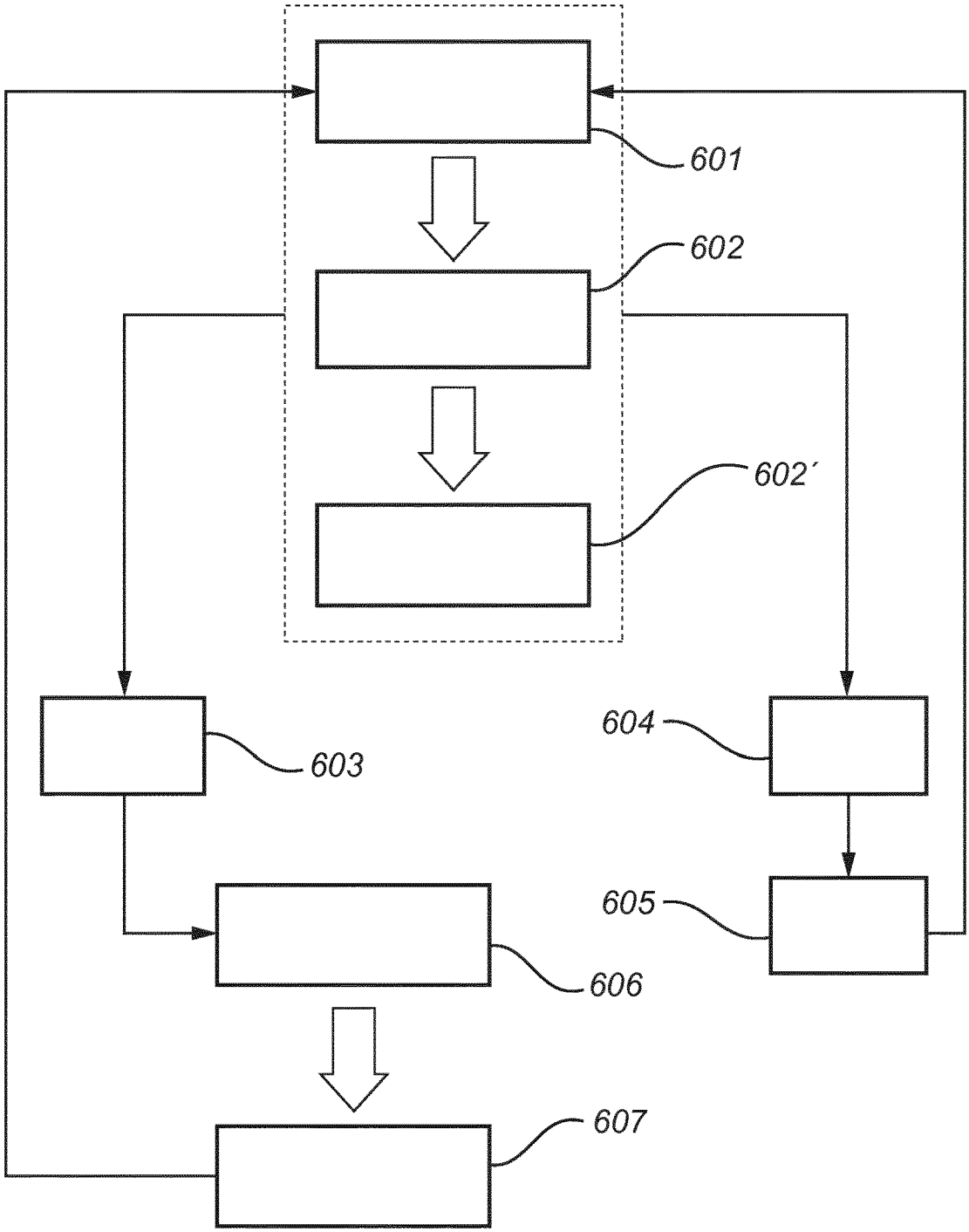
FIG. 3 is a flow chart describing the steps of a method for controlling a turbocharger system in accordance with some example embodiments of the invention.

In an optional fifth step 605, e.g. carried out subsequently to said optional fourth step 604, the combustion engine 100 is operated in a high responsive fuel economy mode, based on the determined NOx parameter from the first step 601. A determined NOx parameter below a pre-defined third threshold determines that the combustion engine 100 is operated in the high responsive fuel economy mode. Hence, the combustion engine 100 may be operated in an engine operational mode which does not focus on reducing the NOx emissions, but instead provide improved engine performance parameters such as e.g. fuel economy and/or torque response. The optional fifth step 605 may for example be carried out as an alternative to the optional third step 603, as shown in FIG. 3, but may as well be carried out prior to, or subsequent to, the optional third step 603.

As mentioned previously, according to one embodiment the turbocharger system 10 comprises a valve 44 for controlling the release of pressurized gas from the tank 40. Thus, in an optional sixth step 606, the valve 44 is operated to release pressurized gas from the tank 40. As previously described, the valve 44 may be connected to a valve pipe 46 which in turn is connected to supply the pressurized gas to the exhaust manifold 102, the exhaust manifold pipe 108, the turbocharger turbine 22 casing, the inlet manifold 104, the turbocharger compressor 24 casing, and/or the inlet manifold pipe 106. The valve 44 may be operated in such a way that the pressurized gas is released from the tank 40 during at least 1 second, such as e.g. between 1 second and 5 seconds.

In a seventh step 607, pressurized gas from the tank 40, e.g. via the valve 44, is injected to drive the turbocharger turbine 22, based on the determined NOx parameter, wherein a determined NOx parameter above the pre-defined first threshold 401 determines that pressurized gas from the tank 40 is injected.

For example, in the low NOx mode, the pressurized gas from the tank 40 may be used to at least partly drive the turbocharger turbine 22, in order to compensate for e.g. a relatively poor torque response which the low NOx mode otherwise would result in.

Preferably, steps 601 to 607 may be repeated.

The control unit 50 may for example be manifested as a general-purpose processor, an application specific processor, a circuit containing processing components, a group of distributed processing components, a group of distributed computers configured for processing, a field programmable gate array (FPGA), etc. The control unit 50 may further include a microprocessor, microcontroller, programmable digital signal processor or another programmable device. The control unit 50 may also, or instead, include an application specific integrated circuit, a programmable gate array or programmable array logic, a programmable logic device, or a digital signal processor. Where the control unit 50 includes a programmable device such as the microprocessor, microcontroller or programmable digital signal processor mentioned above, the processor may further include computer executable code that controls operation of the programmable device.

The processor (of the control unit 50) may be or include any number of hardware components for conducting data or signal processing or for executing computer code stored in memory. The memory may be one or more devices for storing data and/or computer code for completing or facilitating the various methods described in the present description. The memory may include volatile memory or non-volatile memory. The memory may include database components, object code components, script components, or any other type of information structure for supporting the various activities of the present description. According to an exemplary embodiment, any distributed or local memory device may be utilized with the systems and methods of this description. According to an exemplary embodiment the memory is communicably connected to the processor (e.g., via a circuit or any other wired, wireless, or network connection) and includes computer code for executing one or more processes described herein.

The control unit 50 is connected to the various described features of the combustion engine 100 and the turbocharger system 10, and is configured to control system parameters. Moreover, the control unit 50 may be embodied by one or more control units, where each control unit may be either a general purpose control unit or a dedicated control unit for performing a specific function.

The present disclosure contemplates methods, devices and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor.

By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data that cause a general-purpose computer, special purpose computer, or special purpose processing machines to perform a certain function or group of functions.

Although the figures may show a specific order of method steps, the order of the steps may differ from what is depicted.

In addition, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps. Additionally, even though the disclosure has been described with reference to specific exemplifying embodiments thereof, many different alterations, modifications and the like will become apparent for those skilled in the art.

It should be understood that the control unit 50 may comprise a digital signal processor arranged and configured for digital communication with an off-site server or cloud based server. Thus data may be sent to and from the control unit 50.

It is to be understood that the present invention is not limited to the embodiments described above and illustrated in the drawings; rather, the skilled person will recognize that many changes and modifications may be made within the scope of the appended claims. Thus, variations to the disclosed embodiments can be understood and effected by the skilled addressee in practicing the claimed disclosure, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A method for controlling a turbocharger system fluidly connected to an exhaust manifold of a combustion engine and an exhaust after treatment system, said turbocharger system comprising a turbocharger turbine operable by exhaust gases from said exhaust manifold, and a tank with pressurized gas, said tank being fluidly connectable to said turbocharger turbine, wherein said combustion engine is operable in a plurality of engine operational modes, including a low NOx mode in which the combustion engine is operated in order to reduce the NOx emissions, wherein injection of pressurized gas from said tank when the combustion engine is in said low NOx mode enables compensation for an impaired engine performance parameter in the form of impaired torque response, said method comprising the steps of: determining a NOx parameter being indicative of, or correlated to, NOx emissions from said exhaust after treatment system; injecting pressurized gas from said tank to drive said turbocharger turbine with the pressurized gas based on the determined NOx parameter, wherein a determined NOx parameter above a pre-defined first threshold determines that the pressurized gas from said tank is injected, wherein the NOx parameter is the NOx concentration in the exhaust after treatment system, the method comprising the step of measuring NOx emissions using a NOx measuring device arranged in said exhaust after treatment system, or the NOx parameter is correlated to the temperature in the exhaust after treatment system, the method comprising the step of measuring the temperature using a temperature measuring device arranged in said exhaust after treatment system.

2. A method according to claim 1, further comprising deactivating injection functionality of pressurized gas from said tank based on the determined NOx parameter, wherein a determined NOx parameter below said pre-defined first threshold determines that injection functionality of pressurized gas from said tank is deactivated.

3. A method according to claim 1, further comprising operating said combustion engine in a low NOx mode based on the determined NOx parameter, wherein a determined NOx parameter above a pre-defined second threshold determines that the combustion engine is operated in said low NOx mode and/or comprising the step of operating said combustion engine in a high responsive fuel economy mode, based on the determined NOx parameter, wherein a determined NOx parameter below a pre-defined third threshold determines that the combustion engine is operated in said high responsive fuel economy mode.

4. A method according to claim 1, wherein, in which the NOx parameter is the NOx concentration in the exhaust after treatment system, said pre-defined first threshold is a point in the range of 0.15 g NOx/kWh to 1.5 g NOx/kWh or wherein, in which the NOx parameter is the correlated to the temperature in the exhaust after treatment system, said pre-defined first threshold is 1/200.degree. C.

5. A method according to claim 1, further comprising modelling the NOx emissions, or determining the theoretical NOx emissions, based on said NOx parameter.

6. A method according to claim 1, wherein said step of injecting pressurized gas from said tank to drive said turbocharger turbine is independent of an engine speed increasing action of the combustion engine.

7. A control unit configured to perform the steps of the method according to claim 1.

8. A computer program comprising program code means for performing the steps of claim 1, when said program is run on a computer.

9. A computer readable medium carrying a computer program comprising program code means for performing the steps of claim 1, when said program product is run on a computer.

10. A turbocharger system for use together with a combustion engine having an exhaust manifold, and an exhaust after treatment system fluidly connected to said exhaust manifold, said turbocharger system comprising: a turbocharger turbine operable by exhaust gases from said exhaust manifold, a tank comprising pressurized gas, said tank being fluidly connectable to said turbocharger turbine, and a control unit, wherein said combustion engine is operable in a plurality of engine operational modes, including a low NOx mode in which the combustion engine is operated in order to reduce the NOx emissions, wherein injection of pressurized gas from said tank when the combustion engine is in said low NOx mode enables compensation for an impaired engine performance parameter in the form of impaired torque response, wherein the control unit is configured to determine a NOx parameter being indicative of, or correlated to, NOx emissions out from said exhaust after treatment system; initiate injection of pressurized gas from said tank to drive said turbocharger turbine with the pressurized gas based on the determined NOx parameter, wherein a determined NOx parameter above a pre-defined first threshold determines that the pressurized gas from said tank is injected, wherein the NOx parameter is the NOx concentration in the exhaust after treatment system, the control unit being configured to measure NOx emissions using a NOx measuring device arranged in said exhaust after treatment system, or the NOx parameter is correlated to the temperature in the exhaust after treatment system, the control unit being configured to measure the temperature using a temperature measuring device arranged in said exhaust after treatment system.

11. A turbocharger system according to claim 10, wherein said control unit is configured to deactivate injection functionality of pressurized gas from said tank based on the determined NOx parameter, wherein a determined NOx parameter below said first pre-defined threshold determines that the injection functionality of pressurized gas from said tank is deactivated.

12. A turbocharger system according to claim 10, wherein said control unit is configured to: operate said combustion engine in a low NOx mode based on the determined NOx parameter, wherein a determined NOx parameter above a pre-defined second threshold determines that the combustion engine is operated in said low NOx mode, and/or operate said combustion engine in a high responsive fuel economy mode, based on the determined NOx parameter, wherein a determined NOx parameter below a pre-defined third threshold determines that the combustion engine is operated in said high responsive fuel economy mode.

13. A turbocharger system according to claim 10, wherein, in which the NOx parameter is the NOx concentration in the exhaust after treatment system, said pre-defined first threshold is a point in the range of 0.15 g NOx/kWh to 1.5 g NOx/kWh or wherein, in which the NOx parameter is correlated to the temperature in the exhaust after treatment system, said pre-defined first threshold is 1/200.degree. C.

14. A turbocharger system according to claim 10, further comprising a valve for controlling the release of pressurized gas from said tank to the turbocharger turbine, wherein said control unit is configured to control the operation of the valve to release pressurized gas needed for at least partly drive said turbocharger turbine.

15. A vehicle comprising a turbocharger system according to claim 10 or a control unit.

* * * * *